United States Patent [19]

Stilling

[11] Patent Number: 4,905,390

[45] Date of Patent: Mar. 6, 1990

[54] ILLUMINATED DISPLAY

[76] Inventor: Johann Stilling, 1141 Royal York Road, Islington, Canada

[21] Appl. No.: 190,110

[22] Filed: May 4, 1988

[30] Foreign Application Priority Data

Dec. 7, 1987 [CA] Canada ..... 553686

[51] Int. Cl.[4] ..... G09F 13/00

[52] U.S. Cl. ..... 40/549; 40/564; 40/574

[58] Field of Search ..... 40/549, 574, 572, 575, 40/156, 606

[56] References Cited

U.S. PATENT DOCUMENTS

| | | | |
|---|---|---|---|
| 2,707,346 | 5/1955 | Fuller, Jr. | 40/575 |
| 3,722,119 | 3/1973 | Braun | 40/574 |
| 3,848,349 | 11/1974 | Olsen | 40/574 |
| 3,863,372 | 2/1975 | Stilling | 40/549 |
| 4,007,552 | 2/1977 | Brooks | 40/606 |
| 4,169,327 | 10/1979 | Stilling | 40/549 |
| 4,430,819 | 2/1984 | Chandler | 40/156 |

*Primary Examiner*—Kenneth J. Dorner
*Assistant Examiner*—J. Hakomaki

[57] ABSTRACT

A sign box for an illuminated sign, having side walls, namely top and bottom walls and end walls, and having a front face frame movably attached to one of the side walls, the four side walls each defining a generally-planar wall panel with front and rear edges and a forwardly-directed hinge formation, offset from the plane of the planar wall panel, and a junction wall formation formed between the hinge formation and the planar wall, and extending forwardly, and having a rear junction formation formed along the rear edge of the wall panel, one of the front and rear junction members being interengageable with the other of the front and rear junction formations on another wall panel, so that two wall panels may be joined together forming the side walls of the sign box.

9 Claims, 4 Drawing Sheets

FIG. 1
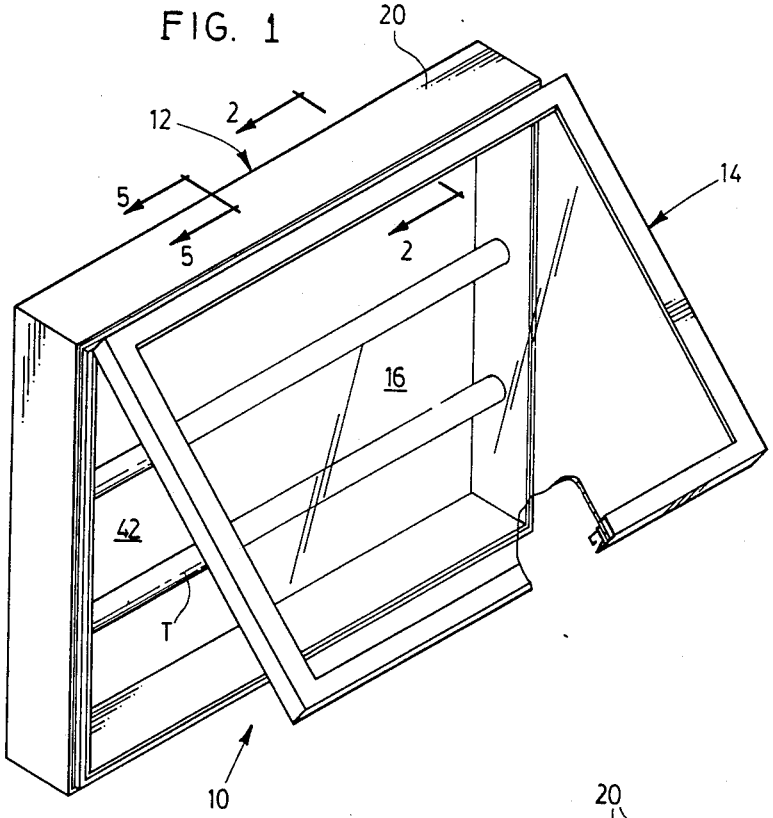
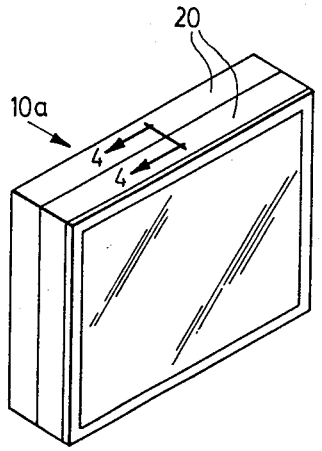
FIG. 1a

ILLUMINATED DISPLAY

The invention relates to an illuminated sign and, in particular, an illuminated sign of the type wherein a rectangular box has side walls formed of metal extrusions.

BACKGROUND OF THE INVENTION

Illuminated signs, such as are used, for example, on store fronts, or in some cases as signage in indoor public areas such as transit terminals and the like usually comprise a rectangular box containing some form of lighting, and a front face frame, which supports the sign panel itself. The sign information may be comprised in a variety of different ways, typically being a translucent panel of plastics material, but also including signs made of flexible synthetic fabrics, and other materials.

Usually, the face frame is hinged on the front of the box, so that it can be swung up and down for replacement of lamps and the like.

A variety of different designs have been proposed for the purpose. One form of illuminated sign box construction is shown in U.S. Pat. No. 3,863,372. The side and end walls of the box were all made of metal extrusions, of identical cross-section.

The contruction shown in that patent has been widely used, and has proved to be satisfactory in practice.

However, there are various areas where improvements can still be made. For example, in order to accommodate the needs of various different customers, it is desirable to offer sign boxes of different depths. Some may want a shallow box and others a much deeper box. Alternatively, some forms of illumination may require a deeper box than others.

In the past this could only be achieved by manufacturing the side and end wall extrusions in different widths.

However, it is obviously desirable that if possible the extrusion should be made modular so that with the same extrusion, simply by using one length, or two lengths attached together, a shallow and a deep sign box could be manufactured from the same extrusion.

In addition, it is desirable as far as possible to reduce the actual amount of metal in the extrusion simply for the sake of saving cost. However, in some circumstances, it is also desirable to reduce the amount of metal for other reasons such as ease of manufacture, shipping and fastening in place.

A further feature is the attachment of the back panel of the box. Usually in this type of illuminated sign box the back panel is made from thin sheet metal, and is attached to the rear edge of the four side walls of the box. Preferably, there should be a continuous sealed junction, at least along the top edge of the back panel, to keep out any moisture which may land on the top wall of the box. In the past, this was achieved, at least in the form of construction shown in the earlier patent, by a channel-like formation on the rear edge of the top wall, which was then swadged or squeezed onto the edge of the back panel. It is desirable, if possible, to eliminate this operation and to simplify the means of attachment, without losing the effectiveness of the seal.

BRIEF SUMMARY OF THE INVENTION

With a view to overcoming the various problems noted above, the invention comprises a sign box for an illuminated sign, four side walls namely top and bottom walls and end walls, and having a face panel, movably attached to one of said side walls, and comprising a face frame adapted to receive a sign face, and a hinge formation on said face frame, and wherein the four side walls are formed of a metallic extrusion, said extrusion in turn defining a generally-planar wall panel, defining front and rear edges, and there being formed on said front edge a forwardly-directed hinge formation, offset from the plane of said planar wall panel interengageable with said hinge formation on said face frame, and a junction wall formation formed between said hinge formation and said planar wall, and extending forwardly, and a rear junction formation formed along said rear edge of said wall panel, one of said front and rear junction members on a said wall panel being interengageable with another of said front and rear junction formations on another said wall panel, whereby two said wall panels may be joined together forming the side walls of the sign box.

More particularly, it is an objective of the invention to provide a sign construction of the type described, suitable for construction of a sign having two faces, and wherein each side wall of the sign box comprises at least two said wall panels, and including a further intermediate connecting wall panel, said connecting wall panel having first and second connecting edges, and having connecting formations on each of said connecting edges, said connecting formations being interengageable with said rear junction formations on said wall panels.

More particularly, the invention further provides a sign construction for a double-faced sign of the type described, and including channel walls formed on the interior of said connecting wall panel, and attachment flanges formed on said channel walls, said attachment flanges being adapted to receive a cover panel, whereby to form an enclosed electrical raceway.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

FIG. 1 is a perspective illustration, partially cut away, showing a typical sign manufactured from a sign box in accordance with the invention;

FIG. 1A is a perspective of a modified form of sign box;

DESCRIPTION OF A SPECIFIC EMBODIMENT

Referring first of all to FIG. 1, a typical illuminated sign is indicated generally as 10. It comprises a rectangular box 12, and face panel means comprising a hinged face frame 14 and a sign panel 16. Such signs of this general construction are typical, and usually include some form of lights, typically fluorescent tubes T within the box 12, for illuminating said sign panel 16 supported in the face frame 14. The panel 16 is usually formed of some synthetic plastic material such as acrylic plastic sheet, or a flexible plastic fabric material typically being a reinforced vinyl material. Typically the sign panel will be at least translucent, and will have some form of graphics printed or silk-screened thereon, so that the illumination in the box illuminates the panel, and the graphics on the panel. As mentioned, there may be cases in which it is desirable to vary the proportions of the box 12.

Various forms of sign boxes are advantageously manufactured with their side walls formed from extruded aluminum but, generally speaking, it has not been practical to manufacture an extruded aluminum wall having a depth of much more than twelve inches. This is due to the limited large extruding presses available. In addition, even if it were possible to form extrusions wider than twelve inches, it would then be necessary to have several different extrusions available in different widths to provide the variety of wall widths required.

Figure 2:
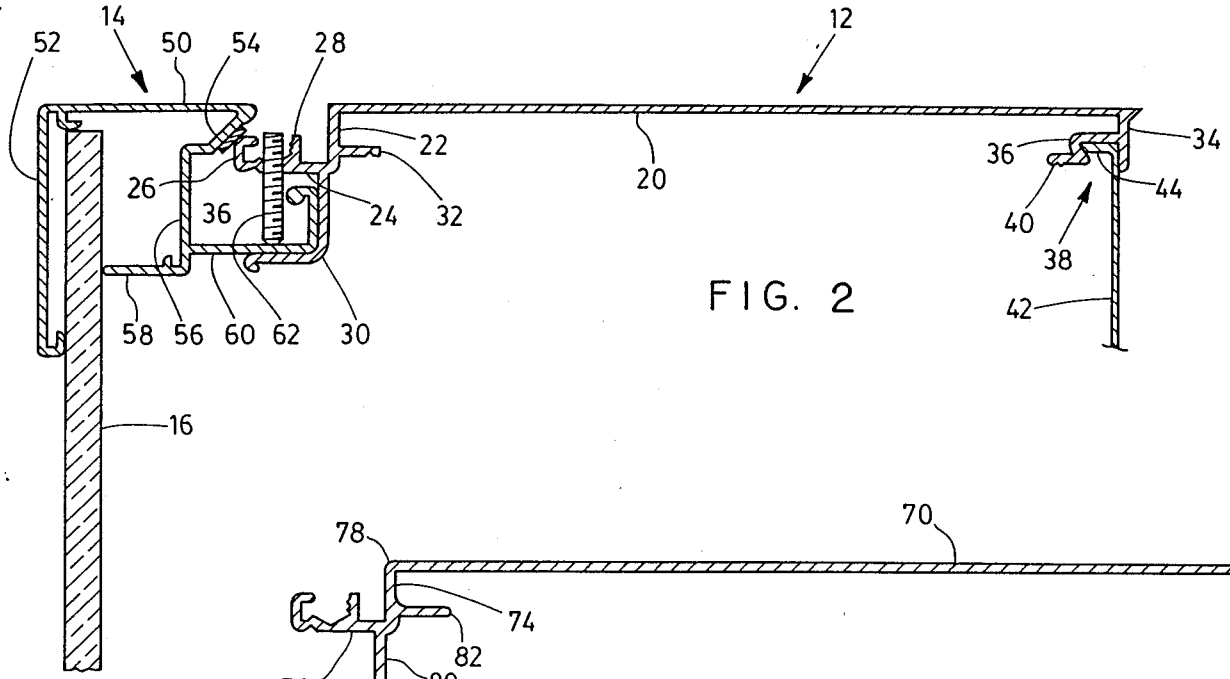
FIG. 2 is a section along the line 2—2 of FIG. 1.

In accordance with the invention, the extrusions for forming the box 12 and frame 14 are shown in more detail in FIG. 2. All four side walls of the box 12 are formed of the same extrusion, for reasons of economy and simplicity.

Each of the top, bottom, and end walls of the box 12 are shown to comprise two generally-planar left and right wall panels 20, each defining, on the right-hand side of FIG. 2, a rearward edge, and on the left-hand side of FIG. 2, a forward edge. It will be appreciated that the terms "left" and "right" and "rearward" and "forward" are used purely by way of illustration and without any limitation being intended thereby.

Along the forward (left-hand in FIG. 2) edge of each wall panel 20, there is formed a generally right angular facing wall 22, to which, in turn, is attached a forwardly-directed sealing wall 24. At the forward end of wall 24, there is formed a generally right angular shaped forward junction formation 26, located in a plane offset from panel 20, the function of which will be described below. An upstanding trim wall 28 is formed along a median portion of wall 24, in a plane parallel with the plane of wall 22.

Approximately at the junction between walls 22 and 24, a generally L-shaped hinge wall 30 is formed, which defines, together with the wall 24, a generally rectangular U-shaped channel in section located in a plane further offset from panel 20. On the interior surface of wall 22, a flange 32 is formed, lying in a plane parallel with the wall 20, which assists in the connection of the four corners of the box 12, in a manner well known in the art.

Along the rearward (right-hand in FIG. 2) edge of each wall panel 20, there is formed a generally right angular dependent adaptor flange 34. Approximately mid way along flange 34, there is formed a generally L-shaped rear junction member 36, defining a channel 38. A junction rib member 40 is formed on the free edge of junction member 36, the function of which will be described below.

The sign box 10 of FIG. 1 is shown consisting of four side wall extensions 12 joined at four corners.

Figure 4:
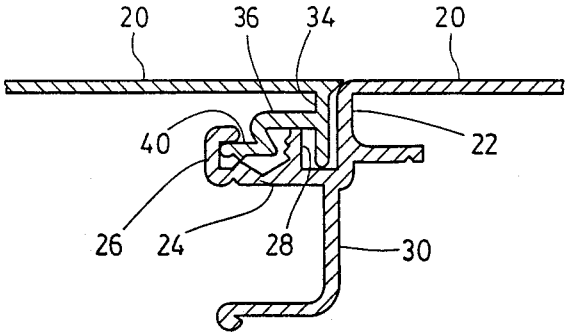
FIG. 4 is a sectional illustration of a portion of FIG. 1A, along line 4—4.

It will however be apparent that eight such side wall extrusions can be used, to make a deeper box 10A, as shown in FIG. 1A. In this case, two wall panels are joined together edge-to-edge in a manner best shown in FIG. 4.

The forward junction formation 26 of the one wall panel 20 is interengaged in the rear junction formation 36 of the next adjacent wall panel 20, thereby joining the two wall panels 20 together.

This provides for great flexibility in the production of sign boxes of different dimensions.

Figure 5:
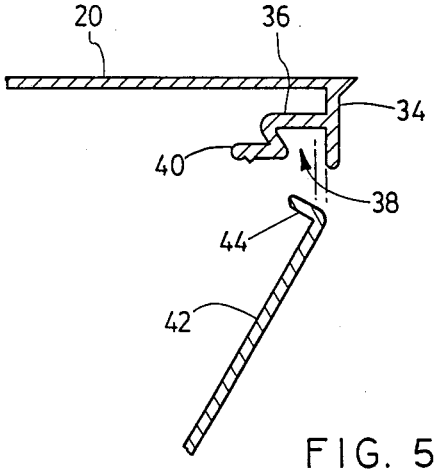
FIG. 5 is an exploded section of the back of the sign box along line 5—5 of FIG. 1.

In the embodiment shown in FIG. 2, the rear of the sign box 12 is simply closed off by a sheet metal panel indicated as 42 in FIG. 5. The top edge of panel 42 is turned over at right angles as at 44, and is captively received in channel 38.

It will however be appreciated that the rear wall panel 42 could simply be a flat panel, and could be attached to the flange 34 by fastenings such as sheet metal screws (not shown), rivets (not shown), or the like.

The four side members of face frame 14 will be seen to comprise a generally-planar outer wall 50, and a right angular generally-planar front facing wall 52. A sealing wall 54 connects with the rearward edge of outer wall 50, in a generally-diagonal fashion and, in turn, connects with an inner support wall 56, lying in a plane parallel to front facing wall 52.

Along the lower edge of wall 56, there is provided a forwardly-directed spacer wall 58.

Also at about the same point a rearwardly-directed generally L-shaped hinge wall 60 extends into engagement with the hinge wall 30 of the sign box 12. Hinge wall 60 fits within the channel defined by the hinge wall 30, and permits a hinging action along the upper edge of the sign box 12.

Typically, a series of retaining screws 62 will be passed through the wall 24, along the upper edge of the sign box 12, to retain the face frame 14 in position.

Such screws may, in some cases, also be inserted in the side walls and also the lower wall of the sign box 12 to hold the face frame in position, but will be removable for servicing.

The face frame 14 can receive a typical sign panel 16 (FIG. 1) formed of sheet plastic material, in any suitable known manner, which is not illustrated herein, since it is generally speaking well known in the art.

Frame 14 may also be constructed to receive a flexible face panel (not shown). Such frames are available in several different designs, and that illustrated here is purely by way of example and without limitation.

Typically, some form of resilient sealing strip (not shown) would be attached along sealing wall 54, and would engage the leading edge of junction formation 26, to seal the same against the entrance of moisture.

Referring now more particularly to FIG. 5, the rear panel 42, and its edge 44, may be engaged in the retaining channel 38, by introducing it at an angle, and then swinging it into a perpendicular position as shown. In this way, at least along the upper edge, the panel 42 can simply be snapped into position without the requirement for fastening.

In addition, it will provide a good seal all the way along such upper edge.

Figure 3:
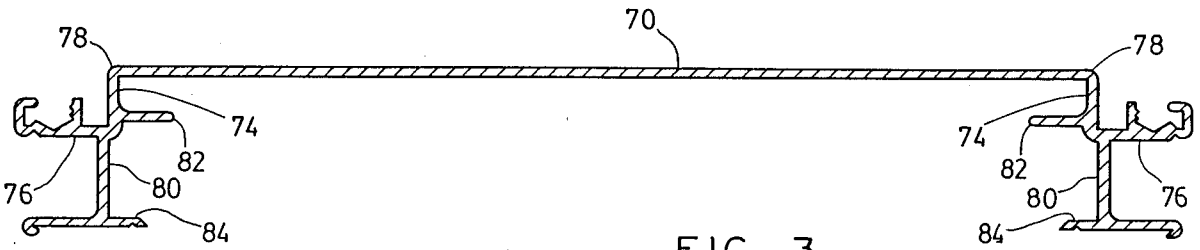
FIG. 3 is a sectional illustration, showing connecting wall panel.
Figure 7:
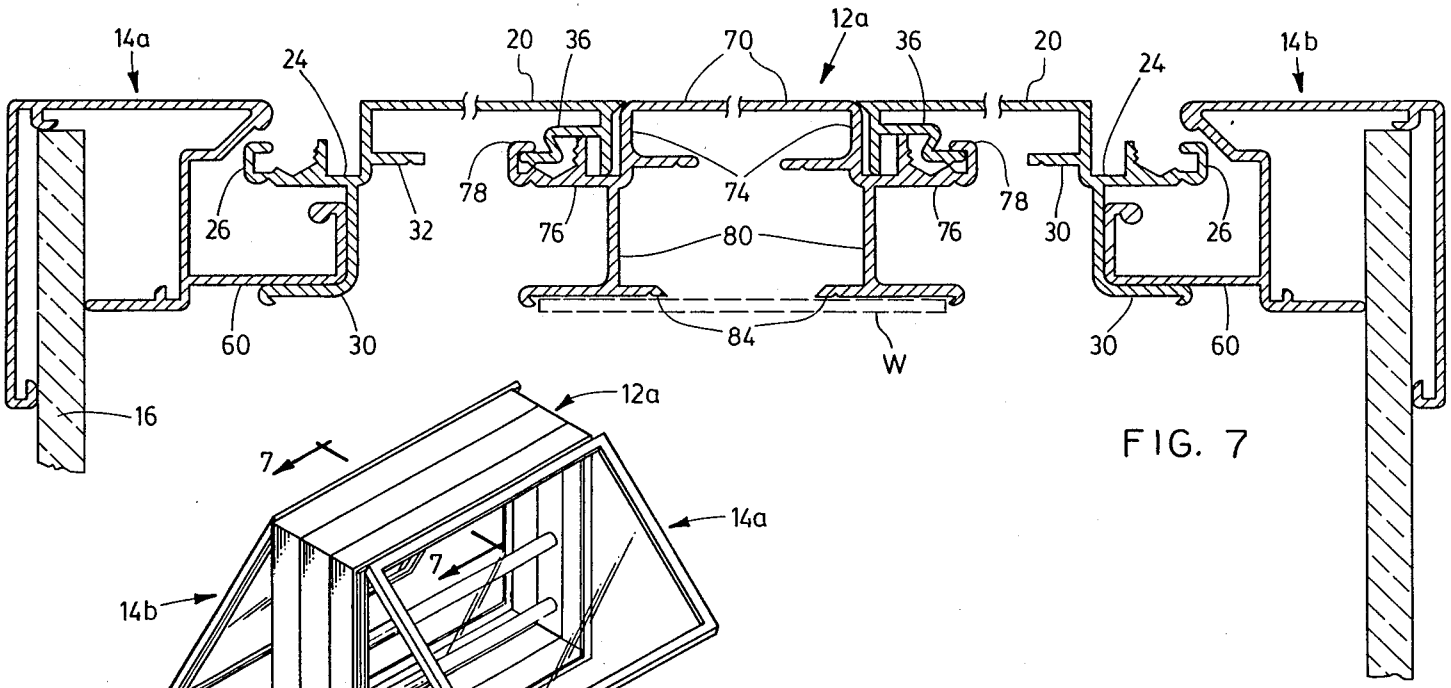
FIG. 7 is a section along the line 7—7 of FIG. 6, enlarged.
Figure 6:
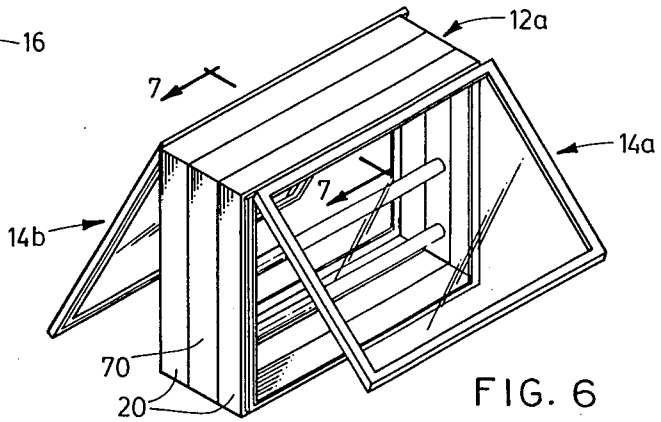
FIG. 6 is a perspective illustration of a double faced sign.

Referring to FIGS. 3, 6 and 7, provision may be made for still greater flexibility in the construction of sign boxes of different types.

A double-face sign if partially illustrated in FIG. 6, and has a box 12*a*, and two face frames 14*a* and 14*b*, on opposite sides. The box 12*a* is of composite, three-part construction, having two wall panels 20, and an intermediate junction wall panel 70.

Junction wall member 70 (FIG. 3) will be seen to comprise a generally planar wall having identical formations along either edge.

Thus along either edge of wall panel 70 there is provided an inwardly-extending facing wall 74, and an outwardly-extending sealing walls 76. Two identical junction formations 78—78 are formed on wall 76 for purposes to be described. It will be noted that the formations 78—78 are substantially similar in shape to forward junction formations 26 of wall panels 20 and thus may be interfitted in rear junction formations 36 of wall panels 20.

Generally L-shaped walls 80 extend from the junction of walls 74 and 76, and define two generally-rectangular U-shaped channels, facing outwardly.

On the interior of walls 74, two retaining flanges 82 are formed, and provide support for a corner junction means (of any known type, not shown) at all four corners, to form the same into an integral box-like structure.

Adjacent the L-shaped corners of the walls 80, there are provided two attachment flanges 84.

Attachment flanges 84 may be used for the attachment of a generally-planar sheet metal raceway wall W. The raceway wall may be attached by screws (not shown), so as to provide a generally rectangular enclosed channel structure for receiving electrical wiring or the like.

As best shown in FIG. 7, the intermediate junction member 70 may be used between two of the wall panels 20. It will be understood that in this embodiment the two wall panels 20 face outwardly, in opposite directions, as shown.

This will provide a relatively wide or deep sign box for what is known as a "double-faced" sign. This type of sign has information panels facing in two opposite directions.

It will also be appreciated however that the intermediate member 70 could be used with one only of the wall panels 20, so as to provide a single-faced sign having different proportions from that of FIGS. 1 or 1A.

It will thus be seen that by the use of the invention, using only a single extrusion for the sign box, sign boxes may be made of either using one extrusion, or using two extrusions (or more) joined together. By use of the junction wall, three extrusions may be joined together to make a sign box of a different depth.

Typically, all of the wall members 20, and 70, will be formed with mitred corners, and will be joined by generally L-shaped angle member (not shown) in a manner well known in the art and requiring no further description.

It will also be appreciated that the face frames 14 are shown as typically being of the type used for supporting rigid thermoplastic panels. Nevertheless other forms of the face frames could be used of a type shown in, for example, U.S. Pat. No. 4,554,754, Inventor John Stilling, for supporting a flexible sign face.

It will also be appreciated that while a generally four-sided sign structure is shown, it is equally possible to make a sign structure having a different number of sides, or having more complex corner formations, for example.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A sign box apparatus for a sign of the type having side walls comprising top and bottom walls and end walls, and having face panel means, movably attached to one of said side walls, and comprising:

a face frame adapted to receive a sign face panel;

a frame hinge formation on said face frame;

and said four side walls each comprising:

a generally-planar wall panel defining front and rear edges;

a forwardly-directed wall hinge formation on said front edge interengageable with said hinge formation on said face frame a forward junction wall formation based between said hinge formation and said planar wall panel, and extending forwardly, and having a predetermined first shape;

a rear junction formation formed along said rear edge of said wall panel, and having a predetermined second shape, adapted to interfit and mate with said predetermined first shape of said forward junction wall formation;

whereby one of said forward and rear junction formations on a said wall panel is interengageable with the other of said forward and rear junction formations on another said wall panel, whereby two said wall panels may be joined together to form said side walls of said sign box.

2. A sign box apparatus as claimed in claim 1 having two said face panel means, and wherein each side wall of said sign box comprises at least two said wall panels, and including a further intermediate connecting wall panel, said connecting wall panel having first and second connecting edges, and having connecting formations on each of said connecting edges, said connecting formations being interengageable with said rear junction formations on said at least two wall panels.

3. A sign box apparatus as claimed in claim 2 for a double-faced sign, and including channel walls formed on the interior of said connecting wall panel, and attachment flanges formed on said channel walls, said attachment flanges being adapted to form an electrical raceway.

4. A sign box apparatus as claimed in claim 1 wherein said wall hinge formation comprises a generally downwardly and a forwardly directed hinge wall located in a predetermined plane offset from the plane of said wall panel.

5. A sign box apparatus as claimed in claim 4 wherein said forward junction wall is formed in a plane intermediate said planes of said wall panel and of said wall hinge formation.

6. A sign box apparatus as claimed in claim 1 wherein said forward junction formation comprises a generally planar wall in a plane offset from and parallel to the plane of said wall panel, and a generally right-angular junction strip at the forward edge thereof.

7. A sign box apparatus as claimed in claim 6 wherein said rear junction formation comprises a generally L-shaped junction member, and having a junction rib formed thereon for interengagement with said planar wall and junction strip of said forward junction formation.

8. A sign box apparatus as claimed in claim 1 wherein said rear junction formation is further adapted to interlock with a portion of a back panel means.

9. A sign box apparatus as claimed in claim 7 including a back panel means having a generally L-shaped upper edge flange portion, said flange portion being adapted to interfit with said generally L-shaped junction member and junction rib formed thereon.

* * * * *